US011248473B2

(12) United States Patent
Dasgupta et al.

(10) Patent No.: US 11,248,473 B2
(45) Date of Patent: Feb. 15, 2022

(54) METAL TRAILING EDGE FOR LAMINATED CMC TURBINE VANES AND BLADES

(71) Applicant: Siemens Energy, Inc., Orlando, FL (US)

(72) Inventors: Arindam Dasgupta, Avon, CT (US); Anand A. Kulkarni, Charlotte, FL (US)

(73) Assignee: Siemens Energy, Inc., Orlando, FL (US)

( * ) Notice: Subject to any disclaimer, the term of this patent is extended or adjusted under 35 U.S.C. 154(b) by 344 days.

(21) Appl. No.: 16/086,324

(22) PCT Filed: Apr. 4, 2017

(86) PCT No.: PCT/US2017/025904
§ 371 (c)(1),
(2) Date: Sep. 19, 2018

(87) PCT Pub. No.: WO2017/176723
PCT Pub. Date: Oct. 12, 2017

(65) Prior Publication Data

US 2019/0112932 A1 Apr. 18, 2019

Related U.S. Application Data

(60) Provisional application No. 62/317,794, filed on Apr. 4, 2016.

(51) Int. Cl.
*F01D 5/18* (2006.01)
*F01D 5/14* (2006.01)
(Continued)

(52) U.S. Cl.
CPC ..... *F01D 5/187* (2013.01); *F01D 5/005* (2013.01); *F01D 5/147* (2013.01); *F01D 5/282* (2013.01);
(Continued)

(58) Field of Classification Search
CPC ..... F01D 5/187; F01D 5/147; F01D 5/282; F01D 5/28; F01D 5/284
See application file for complete search history.

(56) References Cited

U.S. PATENT DOCUMENTS 2,823,893 A * 2/1958 Gerdan ..... F01D 5/187 416/92
3,011,762 A * 12/1961 Pouit ..... F02C 3/073 415/109

(Continued)

FOREIGN PATENT DOCUMENTS

WO 2007001511 A1 1/2007
WO 2015108592 A2 7/2015

OTHER PUBLICATIONS

PCT International Search Report and Written Opinion of International Searching Authority dated Jul. 4, 2017 corresponding to PCT International Application No. PCT/US2017/025904 filed Apr. 4, 2017.

*Primary Examiner* — David E Sosnowski
*Assistant Examiner* — Wesley Le Fisher

(57) ABSTRACT

A turbine blade includes a platform with an internal cavity formed therein and an airfoil extending radially from the platform. The turbine blade includes a first portion made from ceramic matrix composite materials and a second portion made from superalloy materials. The first and second portions are selectively connected to each other via a spur and include an internal cooling circuit extending across both the first and second portions for circulating coolant therethrough. At least one supply passage extends between the internal cooling circuit and the internal platform cavity and includes an array of pin fins and turbulators for diverting coolant to the internal platform cavity.

2 Claims, 4 Drawing Sheets

(51) Int. Cl.
*F01D 5/00* (2006.01)
*F01D 5/28* (2006.01)

(52) U.S. Cl.
CPC .... *F05D 2230/237* (2013.01); *F05D 2230/80* (2013.01); *F05D 2240/304* (2013.01); *F05D 2260/2212* (2013.01); *F05D 2260/22141* (2013.01); *F05D 2300/175* (2013.01); *F05D 2300/6033* (2013.01)

(56) References Cited

U.S. PATENT DOCUMENTS

| | | | | |
|---|---|---|---|---|
| 7,093,359 | B2 * | 8/2006 | Morrison | F01D 5/282 264/257 |
| 7,393,183 | B2 * | 7/2008 | Keller | F01D 5/147 416/223 A |
| 7,837,438 | B2 * | 11/2010 | Campbell | F01D 5/146 415/191 |
| 7,887,300 | B2 * | 2/2011 | Mazzola | F01D 5/147 416/241 B |
| 2006/0120871 | A1 * | 6/2006 | Thompson | F01D 5/147 416/97 R |
| 2006/0226290 | A1 | 10/2006 | Campbell | |
| 2006/0285973 | A1 * | 12/2006 | Keller | F01D 5/147 416/97 R |
| 2009/0252612 | A1 | 10/2009 | Ahmad et al. | |
| 2010/0183427 | A1 * | 7/2010 | Liang | F01D 5/187 415/115 |
| 2013/0276459 | A1 | 10/2013 | Roberts et al. | |
| 2016/0201479 | A1 * | 7/2016 | Abbott | F01D 5/282 416/229 A |
| 2016/0245098 | A1 * | 8/2016 | Roberge | F01D 9/041 |
| 2017/0254206 | A1 * | 9/2017 | Schetzel | F01D 5/187 |
| 2017/0328223 | A1 * | 11/2017 | Subramanian | B32B 18/00 |

* cited by examiner

METAL TRAILING EDGE FOR LAMINATED CMC TURBINE VANES AND BLADES

CROSS-REFERENCE TO RELATED APPLICATIONS

This application claims the benefit of U.S. Provisional Patent Application No. 62/317,794 filed Apr. 4, 2016, the disclosures of which is hereby incorporated by reference herein.

TECHNICAL FIELD

The present invention relates generally to gas turbine engines, and more particularly to internally cooled rotor blades used in such engines.

BACKGROUND

In a turbomachine, such as a gas turbine engine, air is pressurized in a compressor section then mixed with fuel and burned in a combustion section to generate hot combustion gases. The hot combustion gases are expanded within a turbine section of the engine where energy is extracted to provide output power used to produce electricity. The hot combustion gases travel through a series of stages when passing through the turbine section. A stage may include a row of stationary airfoils, i.e., vanes, followed by a row of rotating airfoils, i.e., blades, where the blades extract energy from the hot combustion gases for providing output power.

Since the components within the combustion section and the turbine section are directly exposed to the hot combustion gases, these components require cooling to reduce the amount of damage resulting from the hot gases.

SUMMARY

In one exemplary embodiment, a gas turbine bade is described and which comprises at least a platform having an internal cavity formed therein and including an airfoil extending radially from the platform. The airfoil includes a first portion that is formed from ceramic matrix composite laminate materials and including entirely a leading edge. The airfoil also includes a second potion formed from materials different from the first portion and which includes entirely a trailing edge. The airfoil further includes a connecting member or spur disposed between both the first and second portions for securing the first portion to the second portion to form the turbine blade. Additionally, an internal cooling configuration or circuit is provided and extends across the first and second portions for circulating coolant therethrough.

In another exemplary embodiment, the CMC portion may include a void having a shape corresponding to a shape of the connecting member for receiving at least a portion of the connecting member therein. In this embodiment, the connecting member may contribute to the structural integrity of the turbine blade when disposed within the void. The connecting member may also be formed from the same or similar materials forming, e.g., the metal trailing edge. Additionally, the connecting member may include similar enhanced cooling feature to the internal cooling circuitry, e.g., pin fins turbulators, or in an alternate embodiment, the cooling features of the connecting member may be part of the internal cooling circuit extending across both the CMC and metal portions of the turbine blade.

In yet a further embodiment, a method for retrofitting or repairing an all CMC laminate turbine blade with, e.g., the metal trailing edge portion is described. The method may include the step of removing the entire trailing edge portion of the CMC blade to expose an inner core or surface of the CMC portion. The method may also include the step of machining, carving or boring portions of the inner core or surface to create a void for receiving at least portions of a connecting spur therebetween for securing the CMC portion with the metal portion. Additionally, the method may include the step of permanently joining the CMC portion with the metal portion via a brazing process, and e.g., coating the joined turbine blade to prepare the blade for operation.

BRIEF DESCRIPTION OF THE DRAWINGS

The invention is explained in the following description in view of the drawings that show.

DETAILED DESCRIPTION

The present inventors have found that integrating a metal laminated trailing edge portion with a ceramic matrix composite (CMC) laminate main airfoil body structure solves the challenges of an all CMC vane. This CMC-Metal laminate embodiment allows for a stiffer trailing edge with a lighter overall airfoil construction due to the laminated hollow structure. It should be appreciated that the embodiment disclosed herein may be manufactured through, e.g., chemical etching or 3D printing, which ensures the inclusion of the finest heat transfer features which otherwise would not be possible. An additional feature of the embodiments disclosed herein is to enable leakages in the trailing edge areas. It should be appreciated portions of the blade made from only CMC should be thicker, e.g., at least 6 mm thick in certain embodiments compared to the metal laminated portion which may be as thin as 2 mm. This approach with its advanced cooling design may also enable enhanced heat transfer in this area and multiple other components to be considered using the stacked laminate design.

Figure 1:
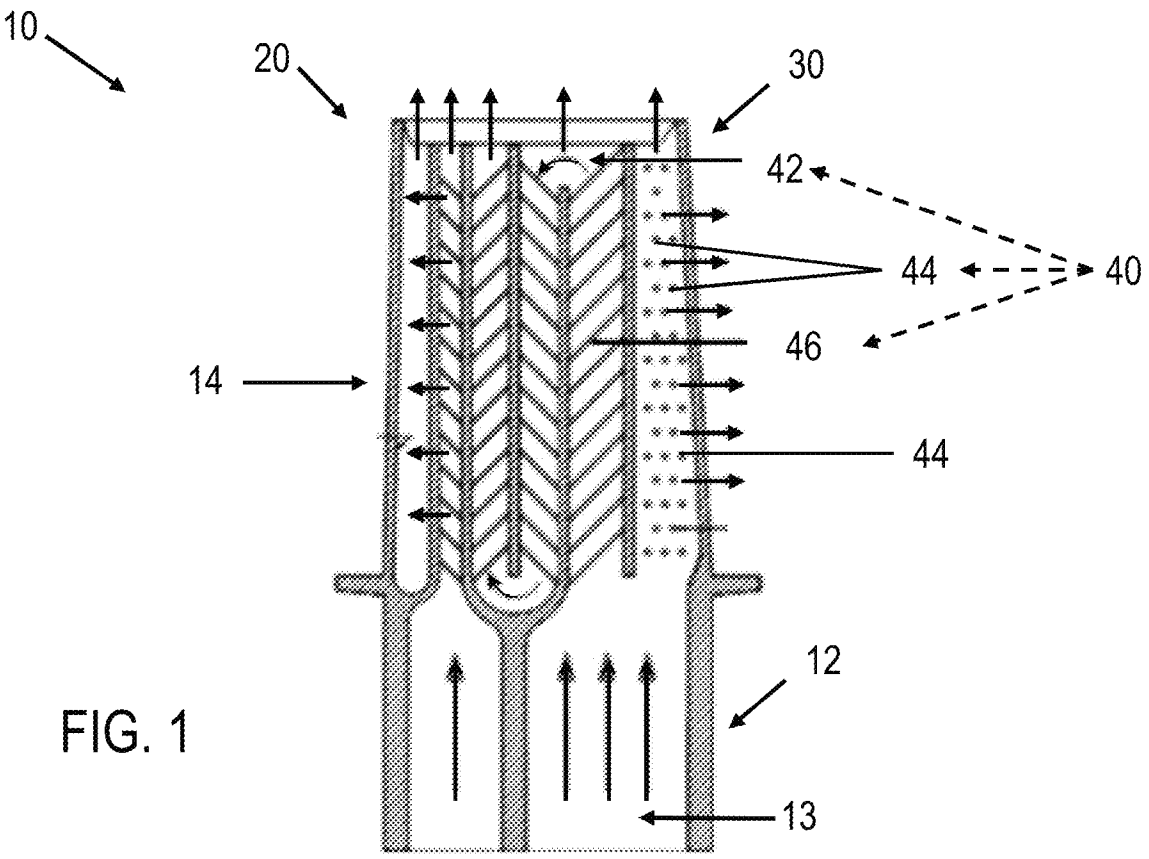
FIG. 1 illustrates a cross sectional view of an exemplary embodiment of a turbine blade with cooling circuit, in accordance with the disclosure provided herein.

Referring now to the drawings wherein the showings are for purposes of illustrating embodiments of the subject matter herein only and not for limiting the same, FIG. 1 shows a cross sectional view of an exemplary embodiment of a turbine blade 10 with cooling circuit.

The turbine blade 10 includes at least a platform 12 having an internal cavity 13 formed therein, and having an airfoil 14 extending radially therefrom. The blade 10 may further include an internal cooling circuit 40, e.g., in the airfoil, for circulating a coolant therethrough. At least one supply passage 42 may also be included and extends between the internal cooling circuit and the internal platform cavity for diverting coolant to the internal platform cavity. It should be appreciated that the coolant may be expelled from holes located in, e.g., the leading and trailing edges of the platform. As shown in FIG. 1, the internal cooling circuit 40 may include an array or plurality of radially extending pin-fins 44 arranged, e.g., in cavities of the platform 12 and/or airfoil 14. Additionally or alternatively, the circuit 40 may also include other convective cooling enhancement features such as turbulators 46 or the like extending, e.g. between walls of the platform, and may further provide structural support to the hollow areas. It should be appreciate that the supplied cooling air may be ejected from cooling holes and onto inner walls of a leading edge path and trailing edge path to carry out an impingement cooling. Additionally or alternatively, the cooling air my flow through the pin fin 44 cooling parts with flow paths forming between the array of pins 44 at the trailing edge to facilitate the pin fin 44 cooling.

Figure 2:
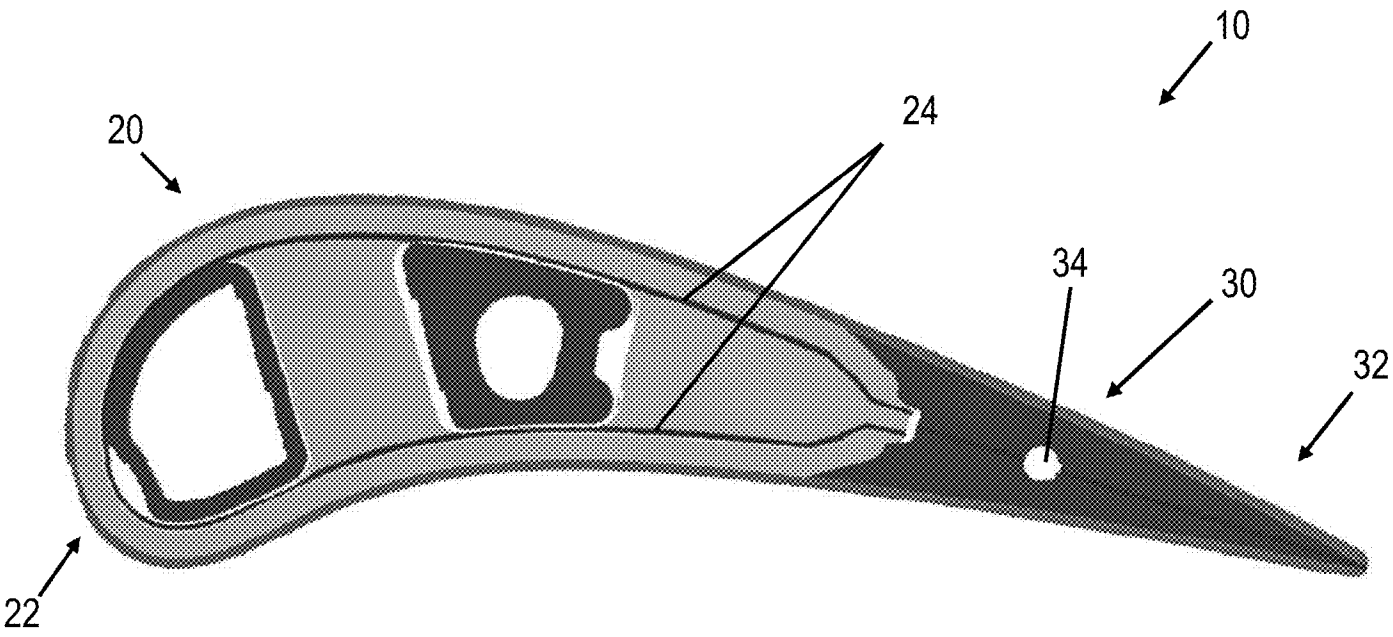
FIG. 2 illustrates a cross-sectional view taken through the airfoil of an exemplary embodiment of a turbine blade, in accordance with the disclosure provided herein.

With continued reference to the figures, and now FIG. 2, the airfoil 14 may include a leading edge 22, a trailing edge 32, a pressure side and a suction side. In one exemplary embodiment of a turbine blade 10, the airfoil 14 may be formed from two portions, e.g., a first portion 20 including entirely the leading edge 22, and a second portion 30 including entirely the trailing edge. In the embodiment of FIG. 2, the first portion 20 may be formed from ceramic matrix composite materials (CMC), e.g., oxide-oxide composites. It should be appreciated that monolithic construction of such materials may not be possible, and therefore, construction may be by laminated structures which may be stacked to complete the blade 10 or particularly the airfoil 14. The second portion 30 may be formed from materials substantially different from the primary materials forming the first portion 20. For example, the second portion 30 may be metal, e.g., formed from superalloy materials. Additionally or alternatively, it should be appreciated that superalloy materials may also be included in the first portion 20, while the second portion 30 includes no CMC materials.

With continued reference to FIG. 2, the metal portion 30 may include a cavity 34, also referred to as a trailing edge cavity 34, which may be supplied cooling air, e.g., from upstream passages that pass over at least parts of the cooling circuit, e.g., pin-fins 44, before being ejected out near a tip of the blade 10 on the pressure side. The CMC portion 20 may include cooling channels 24, e.g., may drain into the trailing edge 32.

Figure 3:
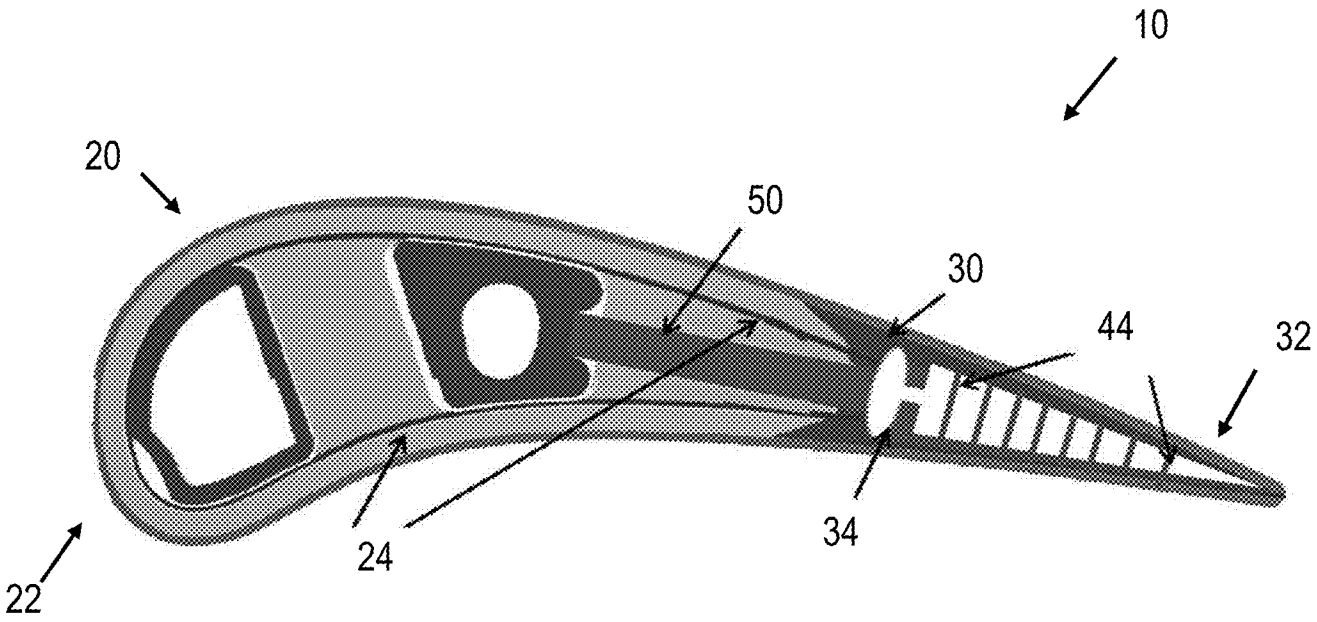
FIG. 3 illustrates a cross-sectional view taken through the airfoil of a further exemplary embodiment of a turbine blade, in accordance with the disclosure provided herein.

With reference now to FIG. 3, the blade 10 may further include a spur 50 or connecting member. The spur 50 may be comprised of similar materials to the materials forming the first or second portion, or a combination of materials. The spur may be a separate structure from the first or second portion and selectively attached or coupled to both the first and second portion, e.g., by welding, sintering, clamping, or any by any means know to persons of ordinary skill in the art and capable of securing the first portion 20 to the second portion 30 while maintaining structural integrity. Additionally or alternatively, the spur 50 may be integrally formed with the first 20 or second portion 30, and dependent upon the portion having similar materials to the spur 50.

In the embodiment of FIG. 3, the spur 50 may be formed from the same or similar materials to that of the metal portion 30. It should be appreciated that the portion of the airfoil 14 not having the spur 50 extending therefrom may include an opening that may correspond to, e.g., the shape and/or profile of the spur 50. For example, in an embodiment where the spur 50 extends from the metal portion 30, the CMC portion 20 may include a split core for receiving at least a portion of the spur 50 therebetween. The split core may be formed from the similar materials forming the spur 50. In yet a further embodiment, the spur 50 may include one or more cavities to facilitate the flow of cooling air through the airfoil 14 and across both the first 20 and second 30 portions.

With continued reference to the figures, the metal portion 30 may include a plurality of pin-fins 44 as part of the internal cooling circuit 40 at the trailing edge 32. It should be appreciated that the metal portion 30 or trailing edge 32 cooling scheme may be directly fed from the platform 12 through a plenum (cooling cavity), which may be connected upstream to the cooling channels 24 in the walls of the CMC portion 20 and downstream to an ejection cavity, which may include, e.g., heat transfer enhancing features, like shaped pin-fins 44 and turbulators 46. The supply plenum 34 may taper with the cross-sectional area decreasing away from the platform 12 to maintain appropriate heat transfer coefficient as coolant is ejected in the span-wise direction.

With continued reference to the figures, additionally or alternatively, in yet another embodiment, the metal portion 30 or the trailing edge 32 may also be laminated. In this embodiment, e.g., the laminate thicknesses of the metal portion 30 should match that of the CMC laminates or it may be different, and it may be bonded, e.g., by diffusion bonding methods proven in high temperature environments. Finer features of the airfoil 14, e.g., the cooling channels, may be etched or generated by 3D printing or a combination. In this process they have features of a few 10 s of microns for enhanced heat transfer which may not be possible with other manufacturing techniques. This enables very high transfer rates and allows acceptable thermal stresses even with reduced cooling air. The reduction in cooling air while maintaining very high turbine inlet temperature increases cycle efficiency. Additionally or alternatively, An outer surface of the metal portion 30 may include a Thermal Barrier Coating and Environmental Barrier Coating to protect the surface and portion 30 from hot gas. It should be appreciated that further coatings, e.g., bond coatings, may also be included on the surface of the portions.

Figure 4:
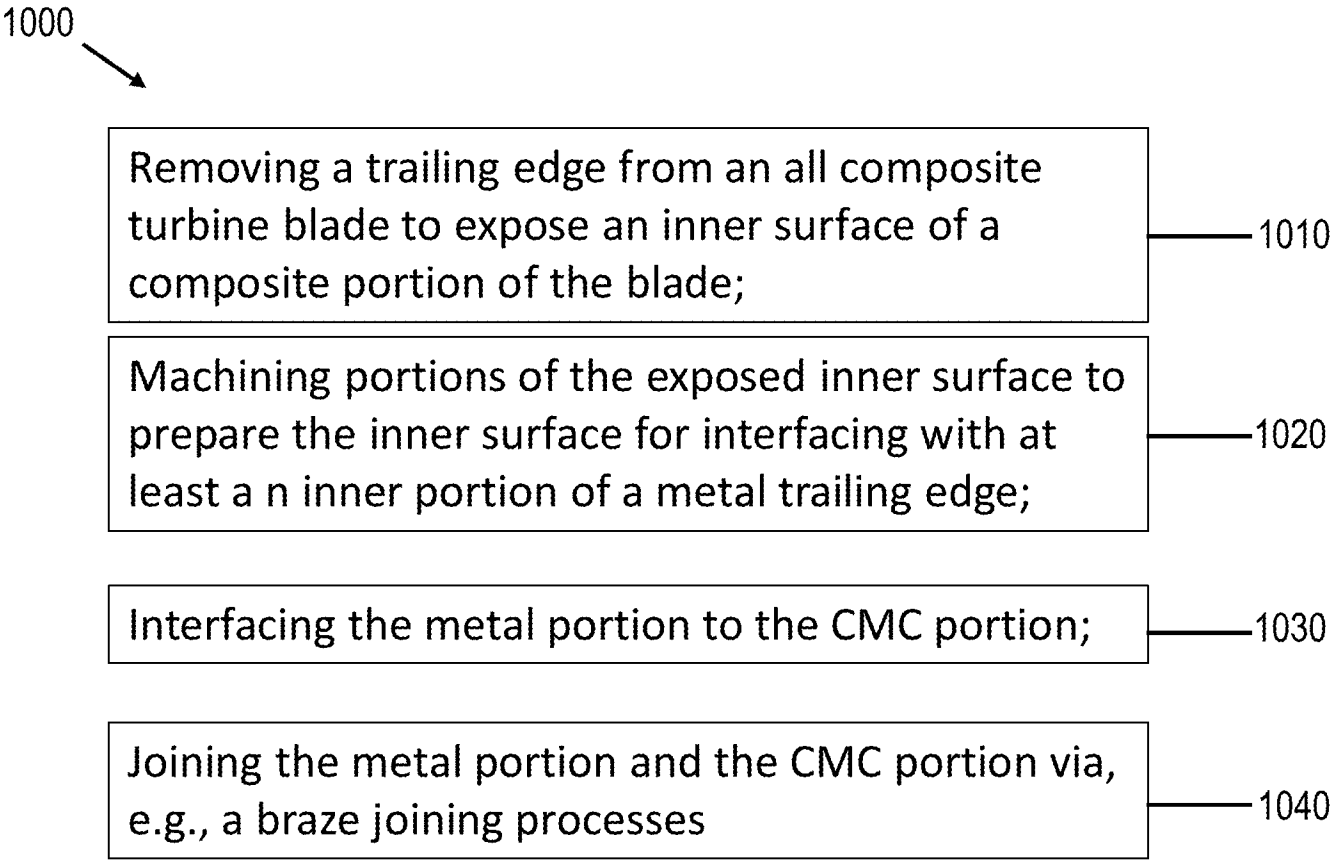
FIG. 4 illustrates a flow chart of a method for repairing an all ceramic matrix composite laminate turbine blade, in accordance with the disclosure provided herein.

With continued reference to the figures, and now FIG. 4, an exemplary embodiment of a method 1000 for repairing an all CMC laminate turbine blade. Upon identifying a damaged portion of the turbine blade at the trailing edge, the method 1000 may optionally include the step of preparing the damaged turbine blade for repair, e.g., by known cleaning processes. After preparing the identifying the damaged portions of the turbine blade, the method 1000 may include the step of removing the trailing edge from the turbine blade (1010). In this step, the trailing edge of the blade is removed, which may include both damaged portion and undamaged portion of the trailing edge. Removal of the trailing edge may be by machining processes or by other processes known in the art for removing or cutting portions of a turbine blade, e.g., an all CMC turbine blade. It should be appreciated that upon removing the trailing edge from the turbine blade, interior portions of the turbine blade, e.g., an inner surface and/or a blade core may be exposed in the remaining CMC portion of the turbine blade. It should be further appreciated that, if needed, after exposing the inner surface or core, the exposed surface may be prepared, e.g., cleaned, for interfacing the CMC portion with the metal portion 30 and/or the spur 50. Additionally or alternatively, the method 1000 may further include an additional machining, carving, or boring out of the inner surface to remove portions of the CMC portion to create a void for receiving at least a portion of the spur 50 therein (1020). It should be appreciated that the void may be a hole or may have any shape and depth corresponding to the spur 50 profile for receiving the spur 50 therein to secure the metal portion 30 to the CMC portion of the damaged blade.

Once the void is defined, the method 1000 may include the step of interfacing the metal portion to the CMC portion (1030). The metal portion 30 should be clamped, coupled, or selectively secured to the CMC portion such that at least portions of the inner surfaces of the CMC portion interfaces with at least corresponding portions of inner surface of the metal portion 30. It should be appreciated that the void should be deep enough, i.e., have enough depth, to allow for the corresponding inner surfaces to interface while receiving e.g., the spur 50 therebetween. Once the metal portion 30 interfaces with the CMC portion, the method 1000 may include the step of joining the metal portion and the CMC portion via, e.g., a braze joining processes, or other processes known to persons of ordinary skill in the art for removably or permanently securing both portions while maintain the operational structural integrity of the blade (1040).

While specific embodiments have been described in detail, those with ordinary skill in the art will appreciate that various modifications and alternative to those details could be developed in light of the overall teachings of the disclosure. For example, elements described in association with different embodiments may be combined. Accordingly, the particular arrangements disclosed are meant to be illustrative only and should not be construed as limiting the scope of the claims or disclosure, which are to be given the full breadth of the appended claims, and any and all equivalents thereof. It should be noted that the term "comprising" does not exclude other elements or steps and the use of articles "a" or "an" does not exclude a plurality.

We claim:

1. A gas turbine engine airfoil comprising:

an elongated hollow shape formed from a first portion claimed to a second portion, wherein the first portion consists essentially of ceramic matrix composite laminate materials and including a leading edge and wherein the second portion is formed from superalloy materials and including a trailing edge; and an internal cooling configuration formed in a hollow portion of the airfoil and spanning across both the first and second portions for circulating coolant therethrough, wherein the first portion includes a first cooling channel between two layers of the ceramic matrix composite laminate materials, wherein the second portion includes a second cooling channel positioned within the elongated hollow airfoil and proximate to the trailing edge, wherein the second cooling channel includes an array of pin fins extending from an inner surface of second portion, and wherein the first cooling channel drains into the second cooling channel, a spur connector disposed between the first and second portion for securing the second portion to a split core of the first portion.

2. The airfoil of claim 1, wherein the internal cooling configuration comprises a flow path extending across both the first and second portions and includes a plurality of turbulators.

* * * * *